United States Patent [19]

Rushforth et al.

[11] 4,172,375

[45] Oct. 30, 1979

[54] COILING SYSTEM FOR METALLIC STRANDS

[75] Inventors: Calvin Rushforth, Andover; George Shinopulos; M. Ronald Randlett, both of Burlington; Terry F. Bower, Needham, all of Mass.

[73] Assignee: Kennecott Copper Corporation, New York, N.Y.

[21] Appl. No.: 901,185

[22] Filed: Apr. 28, 1978

[51] Int. Cl.[2] ..... B21F 3/10; B21F 21/00; B21C 47/02

[52] U.S. Cl. ..... 72/137; 72/139; 140/2; 242/82; 242/83; 266/112

[58] Field of Search ..... 72/66, 135, 137, 139, 72/142; 140/1, 2, 102; 226/4, 109, 112; 242/79, 81, 82, 83; 266/112, 113

[56] References Cited

U.S. PATENT DOCUMENTS

| | | | |
|---|---|---|---|
| 452,889 | 5/1891 | McIlvried | 242/82 |
| 664,896 | 1/1901 | Robertson | 242/83 |
| 1,984,750 | 12/1934 | Lorig | 242/79 |
| 2,227,442 | 1/1941 | DeMillar | 242/83 X |
| 3,204,940 | 9/1965 | Morgan | 242/82 X |
| 3,395,560 | 8/1968 | Cofer et al. | 242/83 X |
| 3,750,974 | 8/1973 | Dibrell | 242/83 |
| 3,873,040 | 3/1975 | Sieurin et al. | 242/82 |
| 4,024,745 | 5/1977 | Karlberger | 140/2 X |
| 4,056,959 | 11/1977 | Ward | 266/112 X |

*Primary Examiner*—E. M. Combs
*Attorney, Agent, or Firm*—John L. Sniado; Anthony M. Lorusso; Peter J. Manus

[57] ABSTRACT

Apparatus for guiding and coiling one or more metallic strands that are continuously advancing along their length from a casting apparatus. A coiling apparatus has an open-top coil-collecting basket with concentric, generally cylindrical inner and outer walls. A rotating cone is disposed over the inner wall. At least one boom and a set of opposed rolls and associated fairing assemblies mounted on the boom guide the strand from the casting apparatus to the coiling apparatus. An exit end of the boom directs each strand vertically downward onto the cone of one coiler. Friction between the strand and the cone lays the strand in the basket in horizontal wraps without a reversal of the laying direction or kinks. The boom exit end mounts a straightener that includes a pair of hydraulically-actuated slide bars that are orthogonal to each other and to the strand. The slide bars produce a cyclic deflection of the strand about the center of the cone to form a uniform, non-tangled coil. The cone-straightener spacing and the cone angle are selected to produce a bend radius in the strand such that the coiled strand does not climb the inner or outer walls of the basket. The diameter of the inside wall is large enough so that the horizontal wraps collapse on one another of their own weight. The boom is hollow and has a series openings adjacent the strand to direct cooling air from the interior of the boom to the strand. In one form the boom has a generally rectangular cross section and carries strands on two vertical walls. A second exit end, positioned midway along the boom directs one strand to a second coiler.

38 Claims, 15 Drawing Figures

24h
24f
24d
156
158
158a
160
162
164
166
168
L
14

COILING SYSTEM FOR METALLIC STRANDS

BACKGROUND OF THE INVENTION

This invention relates in general to apparatus for handling and coiling metallic strands. More specifically, it relates to apparatus for guiding and coiling hot, continuous strands without synchronization between the strand advance and the coiler.

One well established system for coiling metallic strands is simply to wind them on a motor driven drum having a horizontal axis of rotation. Another system, commonly termed a "lazy susan" coiler, wraps a horizontally fed strand about a vertically extending core mounted on a rotatable base driven by a motor. While these arrangements appear to be straightforward, in practice there are several serious disadvantages. First, the rate of rotation of the drum or lazy susan must be synchronized with the rate of advance of the strand. Synchronization, however, requires speed sensing and control devices and is prone to malfunction. Second, for strands of appreciable diameter, a heavy-duty power train is required to accelerate and brake the accumulated tons of strand forming a coil. Third, for the horizontal drum coiler, some arrangement such as a cylindrical cam is required to distribute the strand uniformly along the drum.

An alternative system which avoids some of these difficulties is a laying reel type of coiler where the strand is fed downwardly into an annular space in a basket-like receptacle. Usually, there is also some arrangement for guiding the strand from its vertical orientation to a horizontal loop without reversal of the coiling direction or severe mechanical stress on the strand due to sharp bends. U.S. Pat. Nos. 532,565; 627,722 and 854,809 describe such wire coiling apparatus that form the coil by directing the wire through a rotating guide tube with an entrance end adapted to receive the vertically oriented wire and an output end adjacent the annular coiling space. In the U.S. Pat. No. 854,809, the guide tube is secured on a rotating cone-shaped member. A water spray directed on the coil cools it to reduce surface oxidation of the hot strand.

U.S. Pat. No. 3,204,940 to Morgan describes a more recent coiler of this general type which employs a spiral guide projecting from the upper surface of a rotating cone-shaped member. The guide and cone are positioned under the downwardly fed wire and over the coil collecting volume. Morgan also describes a system for directing a flow of cooling air through the coil.

While these systems avoid the heavy power train of drum and lazy susan coilers, they still require close synchronization between the wire feed rate and the rate of rotation of the guide tube or spiral guide. Also, because the discharge end of the guide tube or spiral has a fixed position relative to the collecting volume, the coil tends to form in a non-uniform manner, particularly for larger diameter strands. Another problem with the Morgan coiler, which has been used for small diameter strands, is that the guide tube wears rapidly and must be replaced periodically.

U.S. Pat. No. 3,750,974 discloses another laying reel coil that uses a cone-shaped member to direct an overhead strand to an annular coil collecting space. In this apparatus, however, the cone is stationary and the laying direction is controlled by fluid forces directed over the surface of the cone laterally against the strand. For strands of any appreciable diameter, however, the fluid flow forces are not sufficiently strong to reliably control the formation of the coil.

Because the metallic strands are typically hot and readily fractured, it is also important to convey them from the production site to the coiler without sharp bends. A common arrangement is to use pulleys or a closely conforming guide tube as shown in the aforementioned U.S. Pat. Nos. 532,565; 627,722 and 3,204,940. While these arrangements guide the strand, they do not cool it except through exposure to ambient room temperature air.

It is therefore a principal object of this invention to provide a coiling system for metallic strands that are continuously advancing from a production apparatus which reliably forms uniform, non-tangled coils without synchronization between the rate of advance of the strand and a coiler.

Another object is to provide a coiling system that forms coils of strands of appreciable diameter without heavy power trains.

A further object is to provide a coiling system for hot strands that cools the strands before they are formed into coils to control surface oxidation of the strand and promote formation of the coil.

A still further object is to provide a coiling system that accepts a wide range of strand sizes and production speeds.

Still another object is to provide a coiling system that minimizes mechanical stress on the strand particularly stress due to a reversal of the coiling direction or the formation of kinks.

Yet another object is to provide a coiling system that simultaneously delivers and coils multiple strands and forms uniform coils which are readily transported and readily uncoiled for further fabrication.

Another object is to provide a coiling system with the foregoing advantages that has a comparatively low cost of manufacture.

SUMMARY OF THE INVENTION

Apparatus for coiling a metallic strand continuously advancing along its length has generally cylindrical concentric inner and outer walls secured on a base to form a coil-collecting annular volume. A cone-shaped member is rotatably mounted over the inner wall. The strand is directed downwardly onto the rotating conical surface to form a horizontal strand wrap in the coil-collecting volume. The cone is driven at a sufficient speed to prevent a reversal of the laying direction. When the strand is brass, the cone is preferably zinc coated.

A strand straightener positioned directly over the cone provides uniformity in the pressure and position of the strand on the cone. A strand deflecting device at the lower end of the straightener introduces a cyclic movement of the strand about the axis of rotation of the cone to distribute the loops uniformly, without tangles or significant unfilled regions. The deflection device is preferably a pair of hydraulically-actuated slide bars that are mutually orthogonal to each other and to the strand. Each slide bar carries a pair of opposed rolls that engage the strand.

The spacing between the cone and the straightener/deflector and the angle of the cone surface are selected to generate a bend radius in the strand that prevents the strand wraps from climbing either the inner or outer walls. The bend radius preferably causes the strand to strike the outer wall at a point between one-half and three-fourths of its height. Good results are achieved if the bend radius is greater than the inner wall radius but less than the outer wall radius. The inner wall diameter is sufficiently large to cause the wraps to collapse on one another of their own weight. The outer wall diameter is preferably less than twice the inner wall diameter.

A series of opposed rollers and associated fairing assemblies mounted on the exterior of a hollow boom guide the strand from a casting apparatus to the coiling apparatus. The fairing assemblies have a mutually inclined pair of guide plates or fairing assemblies that funnel the strand to the nip of the associated roll pair. Once fully threaded, the fairings no longer touch the strand, which is then fully supported by the rolls. A set of openings formed in the boom wall adjacent the strand direct cooling air from the boom interior onto the strand. In a preferred form, adapted for operation between an upward casting apparatus and a laying-type coiler, the strand delivery boom has the general configuration of an inverted U with one vertical leg of the boom forming an exit end that feeds the strand downwardly onto the rotating cone of the coiler. The straightener and the deflection device are mounted on the exit end.

Also in the preferred form, the opposed guide rolls at the first bend are spaced to allow a slight additional bowing of the strand to take up any reversal in motion, and changes in the direction of the boom are gradual to prevent a fracture of the strand. A diverter assembly is pivotally mounted at the entrance end of the boom. In one position it allows a rigid starter rod to avoid the boom, but once the rod is sheared, it pivots to another position where it guides the strand onto the boom. The boom can include at least one additional exit end to feed an additional strand carried along the opposite wall of the boom by a second series of opposed rolls and associated guide plates.

These and other features and objects of the invention will be more fully understood from the following detailed description of the preferred embodiments which should be read in light of the accompanying drawings.

DETAILED DESCRIPTION OF THE PREFERRED EMBODIMENTS

Figure 1:
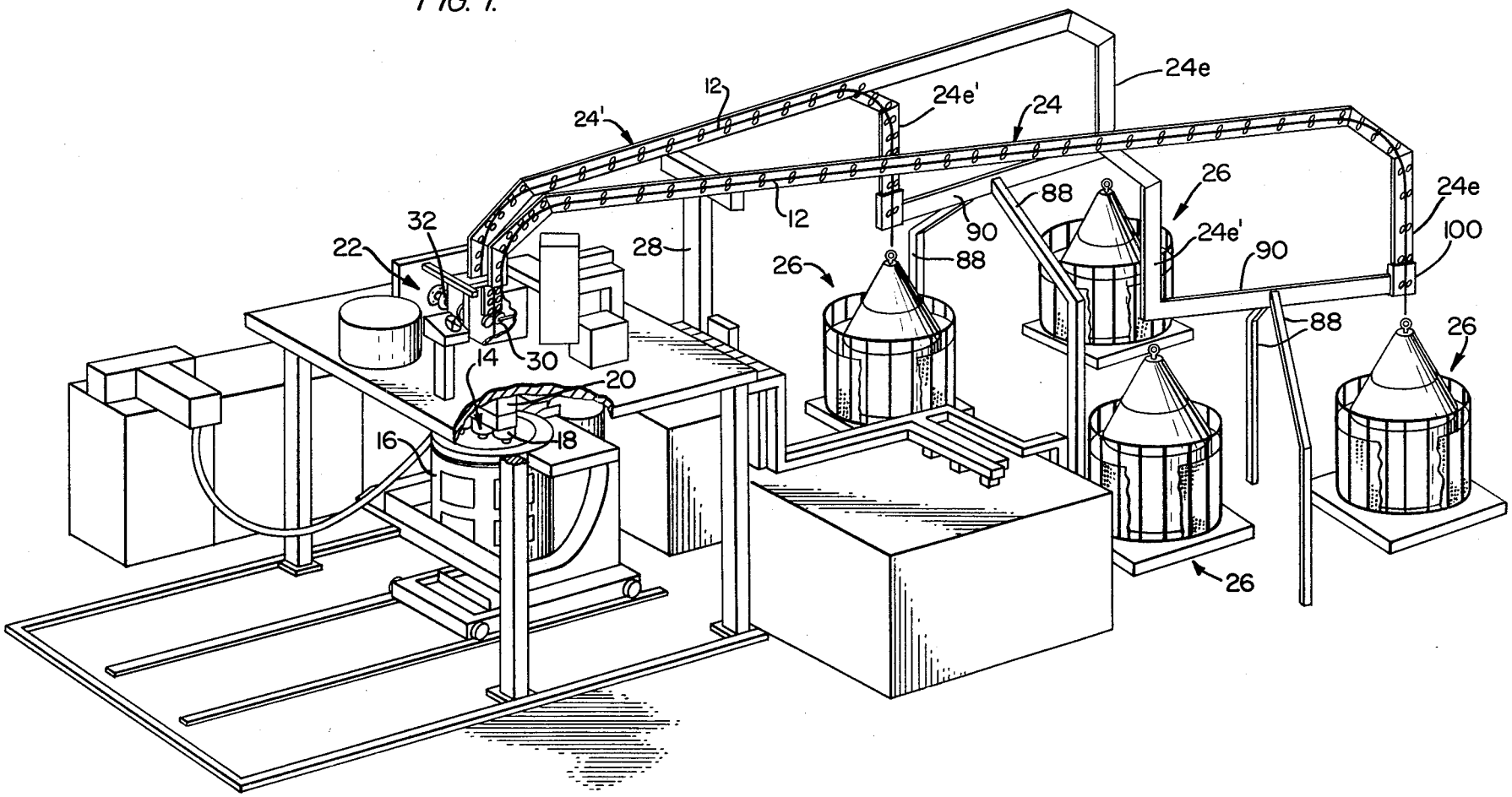
FIG. 1 is a view in perspective of a facility for the continuous production of metallic strands which incorporates a coiling system according to the invention.

FIG. 1 shows a suitable facility for the continuous production of metallic strands in indefinite lengths by casting the strands through cooled molds. While this facility is suitable for producing continuous strands formed from a variety of metals and alloys, it is particularly directed to the production of copper alloy strands, especially brass. For convenience, however, the following will describe the invention with respect to its preferred embodiment, a coiling system for brass strands that are upwardly cast. It should be noted that the strands must be of a material that bends plastically rather than resiliently.

Four strands 12 are cast simultaneously from a melt 14 held in a casting furnace 16. The strands, which can assume a variety of cross sectional shapes such as generally square or rectangular, hexagonal or polygonal, will be described as rods having a substantially circular cross section. Also, the strands can assume a wide variety of cross sectional dimensions, the invention is principally directed to large strands having diameters in the range of ½ to 1½ inches. The strands 12 are cast in four cooled mold assemblies 18 mounted on an insulated water header 20. A withdrawal machine 22 pulls the strands through the mold assemblies and directs them to a pair of booms 24, 24' that guide the strands to four pouring type coilers 26 where the strands are formed into coils. Each boom 24, 24' is hollow to conduct cooling air supplied by the ducts 28 from a central blower along the length of the boom. To space the coilers 26, the booms are angled with respect to one another and the boom 24 is longer than the boom 24'. In other respects, the booms are identical.

The withdrawal machine 22 has four pairs of opposed drive rolls 30 that each frictionally engage one of the strands 12. The rolls are secured on a common shaft driven by a servo-controlled, reversible hydraulic motor 32. A conventional electronic servo-amplifier (not shown) produces a program of signals that control the operation of the motor 32 through a conventional servo-valve (not shown). The program allows variations in the duration, velocity and acceleration of both forward and reverse motions or "strokes" of the strand, as well as "dwell" periods of no relative motion between the strand and the mold assembly following the forward and reverse strokes. The drive rolls 30 can be individually disengaged from a selected strand 12 without interrupting the advance of the other strands. The withdrawal machine provides the motive force to draw the strands from the mold assemblies 18, to advance the strands along the booms 24, 24', and to drive the strands into the coilers 26.

Figure 2:
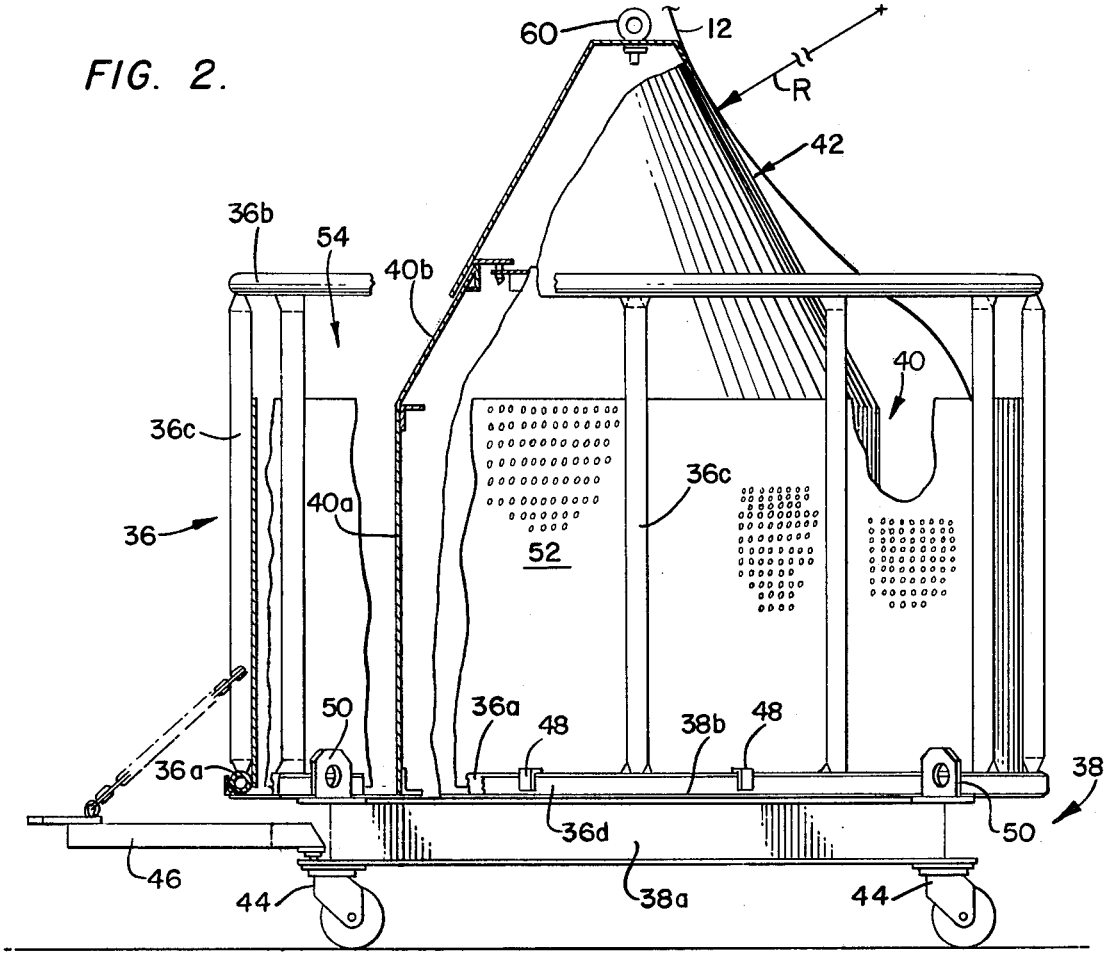
FIG. 2 is a view in side elevation with portions broken away and other portions in section of one of the coilers shown in FIG. 1.
Figure 3:
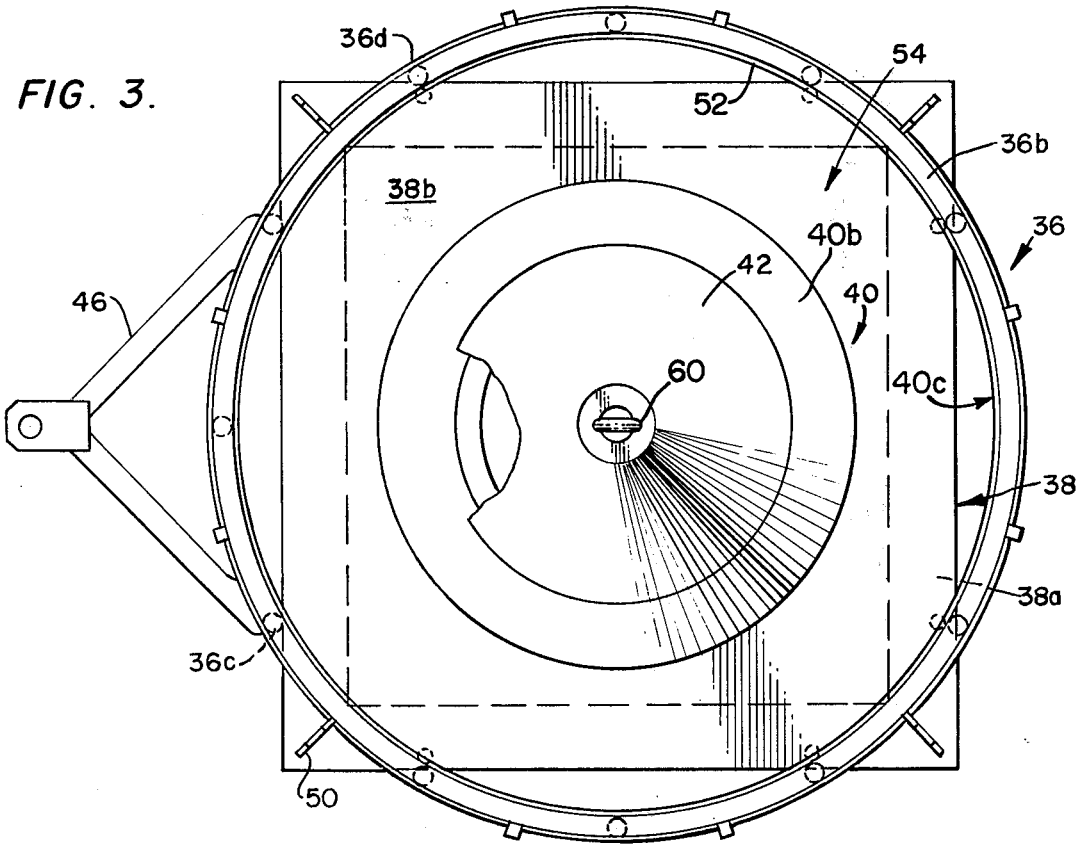
FIG. 3 is a top plan view of the coiler shown in FIG. 2.
Figure 4:
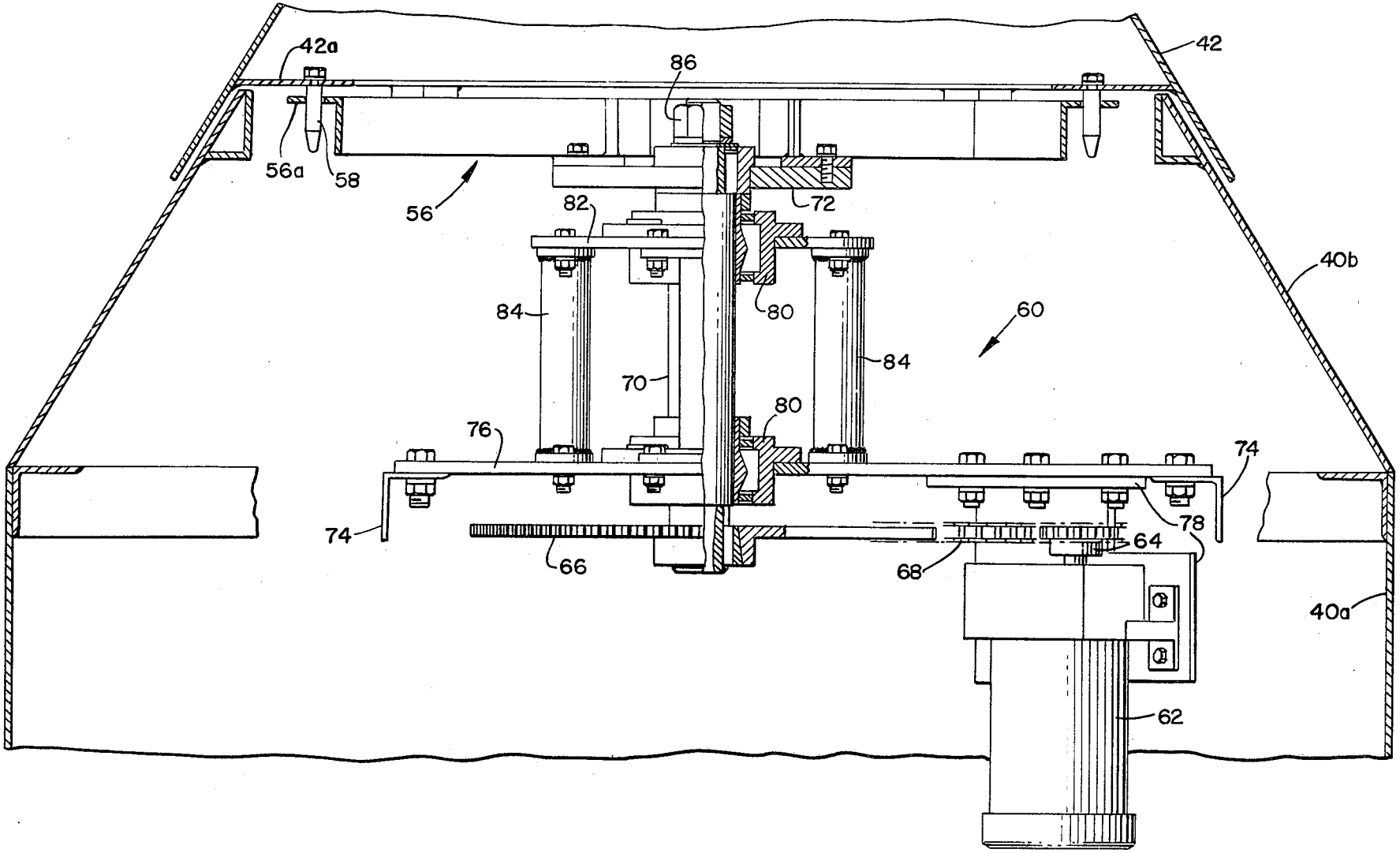
FIG. 4 is a detail view corresponding to FIG. 2 in vertical section with portions in elevation of a mounting and drive system for an upper cone portion of the coiler.

With reference to FIGS. 2–4, each coiler 26 can be generally characterized as a basket-like receptacle 36 on a rolling pallet 38 with a central spindle 40 that support a motorized cone 42. The base or pallet 38 has a square support frame 38*a* formed by four steel I-beams and a generally square sheet metal floor 38*b* that rests on the frame. The floor 38*b* supports the coiled strand. The I-beam frame provides the strength necessary to support coil loads that can weigh many tons. Four casters 44 mounted on the frame facilitate moving the coiler 26 into and out of a strand receiving position under a boom exit end 24*e* or 24*e'*. A tow bar 46 secured to the frame provides a convenient hitch for a tow vehicle. The coiler also preferably has locating members (not shown) that extend from the frame 38*a* to the floor to position the coiler under the boom end and maintain that position during the coiling operation.

The basket-like receptacle 36 is formed by a generally cylindrical outer wall 40*c* centered on the base 38. Tubular members including a lower circular frame 36*a*, an upper circular frame 36*b* and a series of upright posts 36*c* that extend between the frames 36*a* and 36*b* define the outer wall. The lower frame 36*a* rests on a circular, flanged support member 36*d* that carries a set of removable clamps 48 (FIG. 2) to hold the frame 36*a* in place. Four upright members 50 secured to the frame 38*a* at each corner also locate the circular frame 36*a* on the base and provide connection sites for an overhead crane (not shown). The tubular frame 36*a*, 36*b*, 36*c* surrounds and supports a cylinder 52 of heavy gauge sheet metal that is preferably perforated to provide visibility of the forming coil and to circulate room air through the coil. The sheet metal cylinder 52 has a smooth surface that defines the outer diameter of the coil but does not engage or "catch" the strand. It will be understood, however, that many alternative outer wall constructions are possible. For example, the cylinder 52 can be eliminated or the tubular frame can be replaced by upright support bars bolted to the base.

The spindle 40 has a cylindrical inner wall 40*a* that is concentric with the outer wall to define an annular coil collecting volume 54. The inner wall 40*a* is formed from heavy gauge sheet metal secured at its lower edge to the pallet floor 38*b* and joined at its upper edge to a frustoconical shoulder portion 40*b*. The diameter of the inner wall 40*a* determines the inner diameter of the coil. It is therefore selected to be sufficiently large that the largest diameter strand to be coiled will lie substantially in a horizontal plane as it is formed into a circular loop. In other words, each turn collapses due to its own weight. For a strand with a diameter d and a density $\rho$, the inner wall diameter D should satisfy the relationship $D > K^{\frac{1}{2}} d^{\frac{1}{2}}$ where $K = \sigma ys/4\pi\rho$ and $\sigma ys$ is the strand yield strength. As an example, to coil a three-quarter inch diameter strand of a #CDA 260 soft brass alloy, typical dimensions for the coiler include an inner wall diameter of five feet, an outer wall diameter of eight feet and a collecting volume height of five feet measured from the floor 38*b* to the lower edge of the sloped shoulder 40*b*.

A principal feature of this invention is the motorized cone 42 which is mounted over the spindle shoulder 40*b* and a turntable 56. The cone 42 has an inwardly projecting annular flange 42*a* positioned slightly above the upper edge of the shoulder. The flange 42*a* carries a set of pins 58 that connect the flange to an opposed flange 56*a* of the turntable 56. The upper end of the cone is trimmed and carries an eyelet 60 for lifting the cone off the turntable to stack the coilers or for access to a cone drive assembly 59 mounted within the spindle 40. The cone is sufficiently heavy to avoid the use of fasteners. As will be described in greater detail below, the slope of the cone 42 is selected to cooperate with a length of the strand over a substantial area of the cone and to direct it from the boom to the volume 54. The cone frictionally engages the strand, and because the cone is rotating, directs the strand to a horizontal orientation with a laying direction determined and maintained by the rotation of the cone. In the illustrated embodiment, the cone surface forms an angle of approximately thirty degrees with the vertical.

A relatively low power electric motor 62 rotates the turntable 56 through a drive train that includes a small drive sprocket 64 keyed to the motor shaft, a large driven sprocket 66, a chain 68 connecting the sprockets, a drive shaft 70 and a drive flange 72 bolted to the turntable and keyed to the drive shaft. A generally rectangular frame 74 is welded to the spindle wall 40*a* and in turn supports a base plate 76 and a motor mounting bracket 78. A pair of flanged bearing blocks 80 hold the drive shaft 70. The upper block 80 is secured to a plate 82 supported by column spacers 84. A nut 86 threaded on the upper end of the drive shaft secures the drive flange 72.

The motor 62 rotates the cone 42 at a speed somewhat greater than the rate at which the strand is being laid. In general, the speed of rotation C of the cone should be greater than $S/\pi D$, where S is the strand speed and D is the inner wall diameter of the receptacle 36. The speed, however, should only be slightly greater than $S/\pi D$ to reduce wear of the cone surface. It should be noted that the rotation speed is typically low. For example, with a strand speed of 120 inches per minute and an inner wall diameter of sixty inches, the cone speed C should be greater than 0.6 rpm. The outer surface of the cone is preferably coated with a material that is softer than the strand material and compatible with it. For brass strands, the cone is preferably galvanized (zinc coated).

With reference to FIGS. 1 and 5–8, the strand delivery booms 24, 24' are each formed from hollow weldments or sections having a generally rectangular cross section defined by the parallel side walls 24*a*, a bottom wall 24*b* and a top wall 24*c*. The delivery path for each strand 12 has the general configuration of an inverted U. A boom entrance end section 24*d* and an exit end section 24*e* are vertically oriented. Adjacent angled sections 24*f* and 24*g*, respectively, define a gradual bend in the delivery path to a generally horizontal intermediate section 24*h* or 24*h'*. Each boom 24, 24' has a second exit end 24*e'* similar to the end 24*e* and an adjacent angled section 24*g'* similar to the section 24*g* extending downwardly from the section 24*h* or 24*h'* to feed a second strand 12 carried along one of the walls 24*a*. The delivery path for this second strand therefore also has an inverted U shape, but a shortened horizontal path section. The exit ends 24*e* and 24*e'* are spaced from one another sufficiently to allow one of the coilers 26 to be positioned directly under the strands as they leave the exit ends. Each boom 24, 24' also has legs 88, 88 that support a cross beam 90 welded between the exit ends 24*e* and 24*e'*. By way of illustration only, the boom sections are formed of one-quarter inch sheet steel with a typical cross-sectional height of ten inches and width of four inches. The booms 24, 24' extend longitudinally twenty-five and thirty feet, respectively, to the near coilers and thirty-seven and forty-two feet, respectively, to the far coilers. The angled sections 24f, 24g and 24g' are inclined at forty-five degrees and have a vertical height of approximately three feet.

A series of opposed pairs of pulleys or rolls 92 and associated fairing assemblies 94 carry the strands along the booms 24, 24'. The fairing assemblies include a pair of mutually inclined guide plates that funnel the strand to the nip of the associated roll pair. The rolls are rotatably mounted on either double shafts 96 (FIG. 7) that carry a roll on both sides of the boom or a single shaft 98 (FIG. 8) that carries only one roll. The shafts are welded in suitable openings drilled through the boom walls 24a. The roll pairs are preferably spaced one foot apart with one of the fairing assemblies 94 before each roll pair. Once the strand is fully threaded, it is supported only by the rolls and does not touch the fairing assemblies. Thus, the fairings only mar the first few inches of strands.

Air outlet holes 95 are drilled in the side walls 24a directly alongside one of the strands 12 engaged by the adjacent pair of rolls 92. It should be noted that an air passage such as a set of large diameter holes are also drilled in the boom bottom wall 24b over the upper end of the angled section 24g' to direct the cooling air into the sections 24g' and 24e'. The booms 24, 24' therefore function as a cooling manifold as well as a delivery system.

Figure 6:
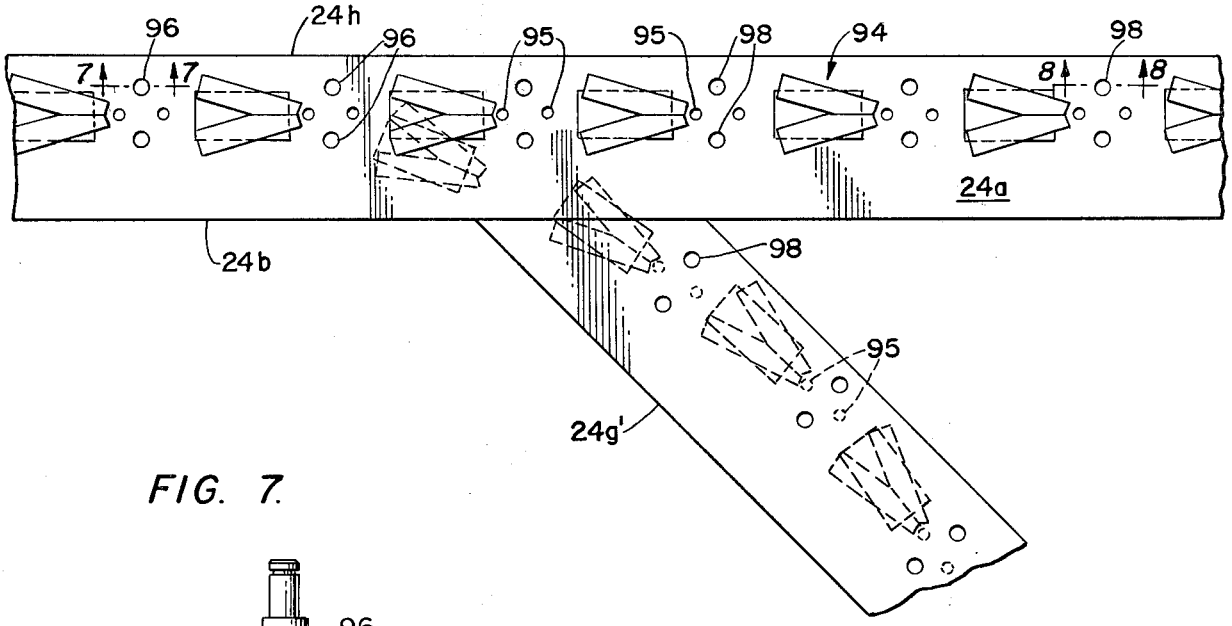
FIG. 6 is a detailed view of a central portion of the strand delivery boom shown in FIG. 5.
Figure 7:
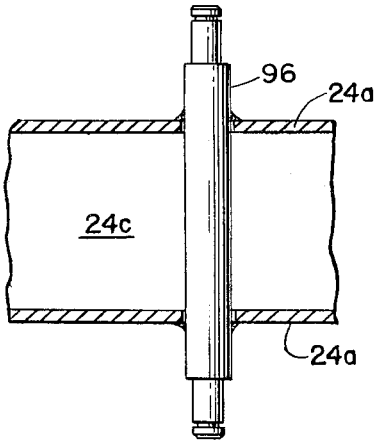
FIG. 7 is a view in horizontal section of a roll mounting arrangement taken along the line 7—7 of FIG. 6.
Figure 8:
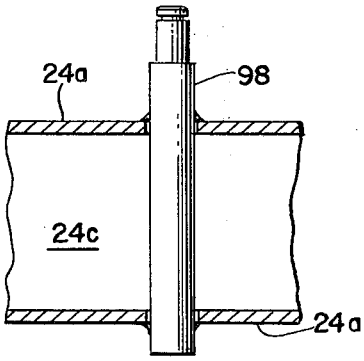
FIG. 8 is a view corresponding to FIG. 7 taken along the line 8—8 of FIG. 6.

The rolls are generally positioned with the nip of each opposed pair centered on the boom side wall. However, the positions of the roll pairs along bends in the boom are offset to provide a uniform radius of curvature. Such an offset is illustrated in FIG. 6 by the roller pairs mounted on the section 24g'. Also, in the roller pairs near the entrance end 24d (FIG. 12) that defines the first bend in the strand as it leaves the casting apparatus are spaced from one another by a distance L in excess of the normal, strand-engaging spacing. Because of this additional spacing, during the forward stroke component of the strand advance the strand bows outwardly away from the inner roll. This bowing creates a slight "slack" so that on the following reverse stroke the withdrawal machine accelerates only a relatively short, bowed length of strand rather than the entire length of strand carried on the booms 24, 24' and entering the coiler.

Figures 12, 13, 14:
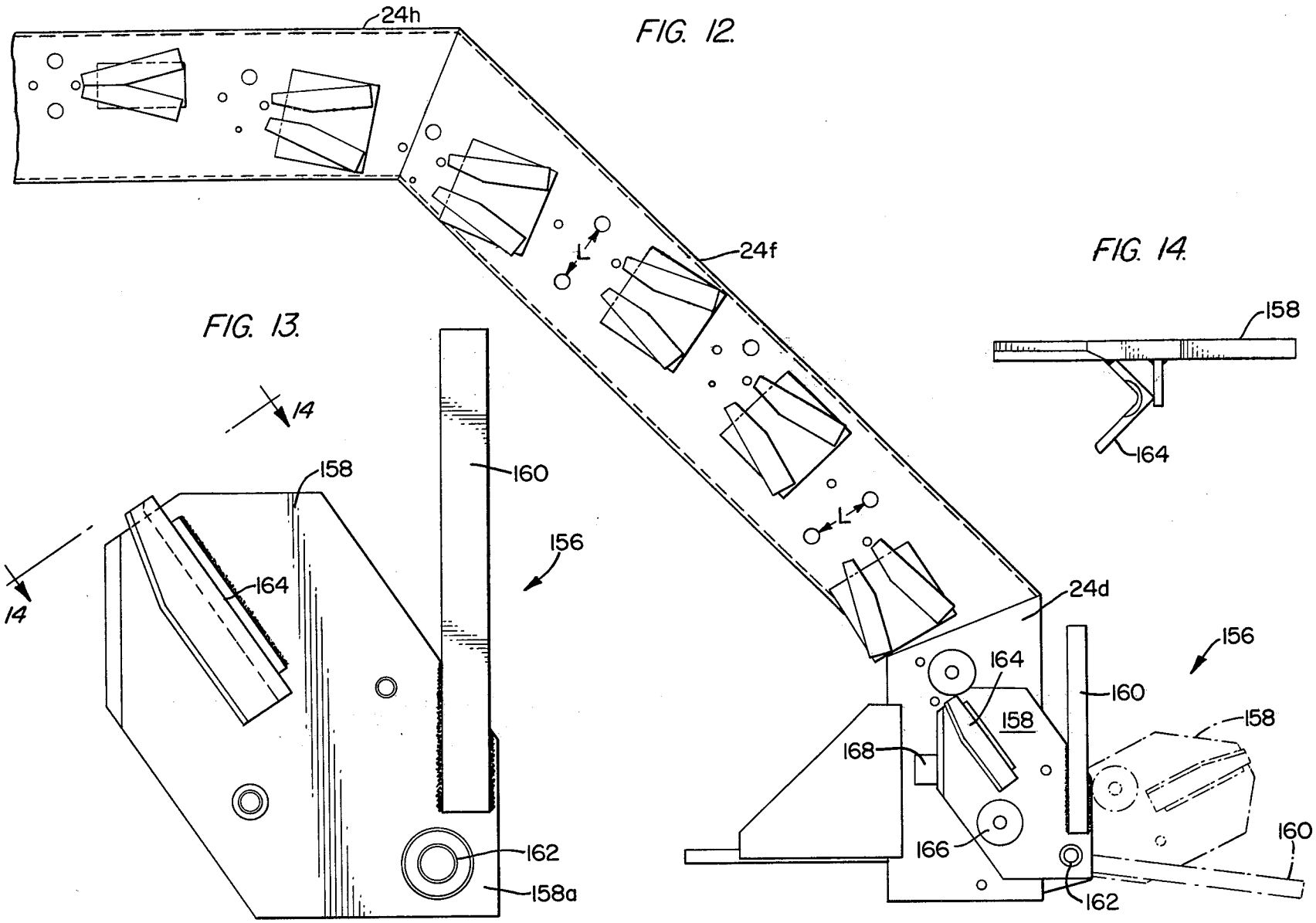
FIG. 12 is a view in side elevation of the entrance end of the boom shown in FIG. 1 including a strand diverter.
FIG. 13 is a view in side elevation of the diverter shown in FIG. 12.
FIG. 14 is a view in elevation taken along the line 14—14 in FIG. 13.

With respect to FIGS. 12–14, a diverter 156 is mounted on the entrance section 24d of each boom 24, 24' for each strand. The diverter includes a plate 158 and a handle 160 that pivot together about an axis 162 located near a lower corner 158a. The plate carries a single guide plate or fairing assembly 164 and a single roll 166 disposed generally below the fairing 164. The diverter pivots between a normal operating position shown in solid lines in FIG. 12 and a start-up position shown in phantom in FIG. 12. In the operation position, the plate abuts a stop block 168 mounted on the end 24d. Because of the location of the axis 162 with respect to the center of mass of the plate 158 and the members mounted on the plate, it remains in either the operating or start up position until manually moved to the other position by the handle 160.

The diverter 156 is used in conjunction with a rigid starter rod that is convenient in starting a casting. The rigid rod is preferred because it is easier to thread into the mold assembly. On start up, the lower end of the rod is in the casting zone of the mold assembly. The casting forms on a bolt secured to the lower end of the starter rod. The starter rod and the beginning portion of the casting are advanced from the mold assembly by the withdrawal machine 22. The diverter in its start up position allows the start up rod to advance directly upward. When the rod is clear of the withdrawal machine rolls, the advance is stopped briefly while the starter rod and the bolt are sheared from the strand. The diverter is then rotated to its operating position and the strand advance is resumed. The diverter then directs the strand to the boom.

Figure 5:
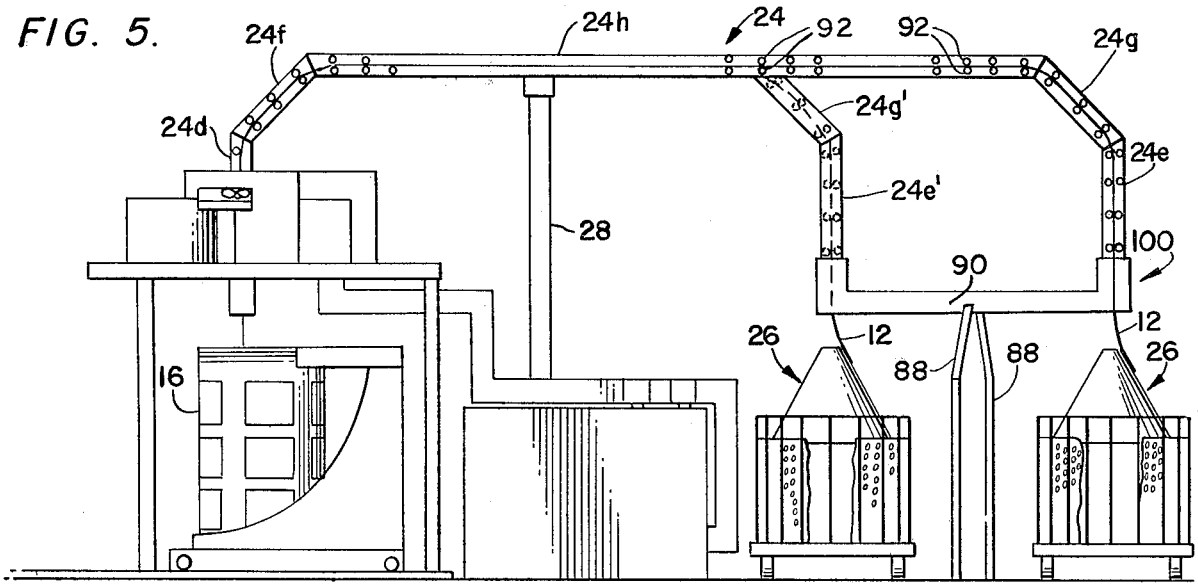
FIG. 5 is a simplified schematic view in side elevation of the production facility shown in FIG. 1.
Figure 9:
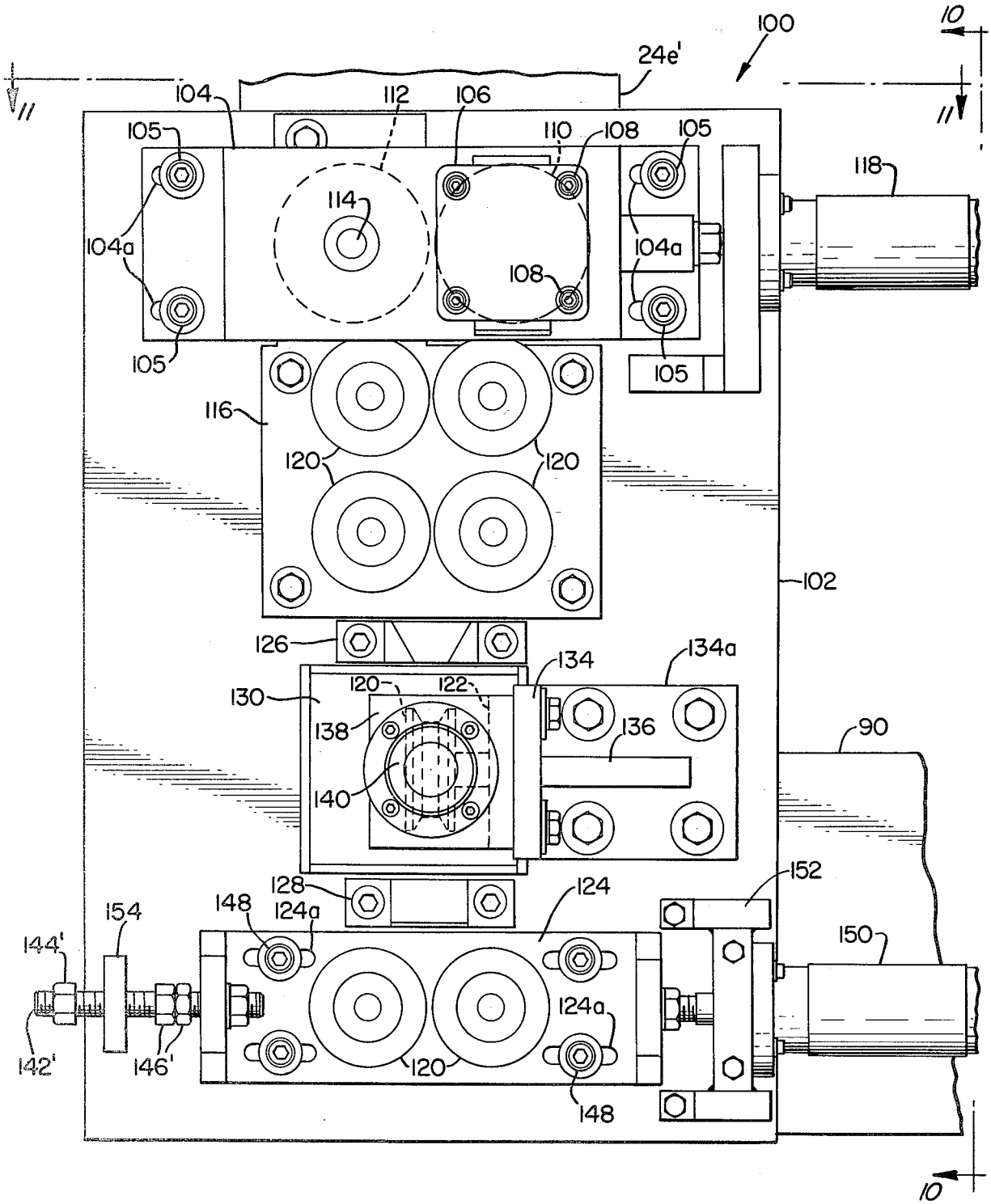
FIG. 9 is a view in side elevation of a straightener and a strand deflection device mounted on an exit end of the boom shown in FIGS. 1 and 5-8.
Figure 10:
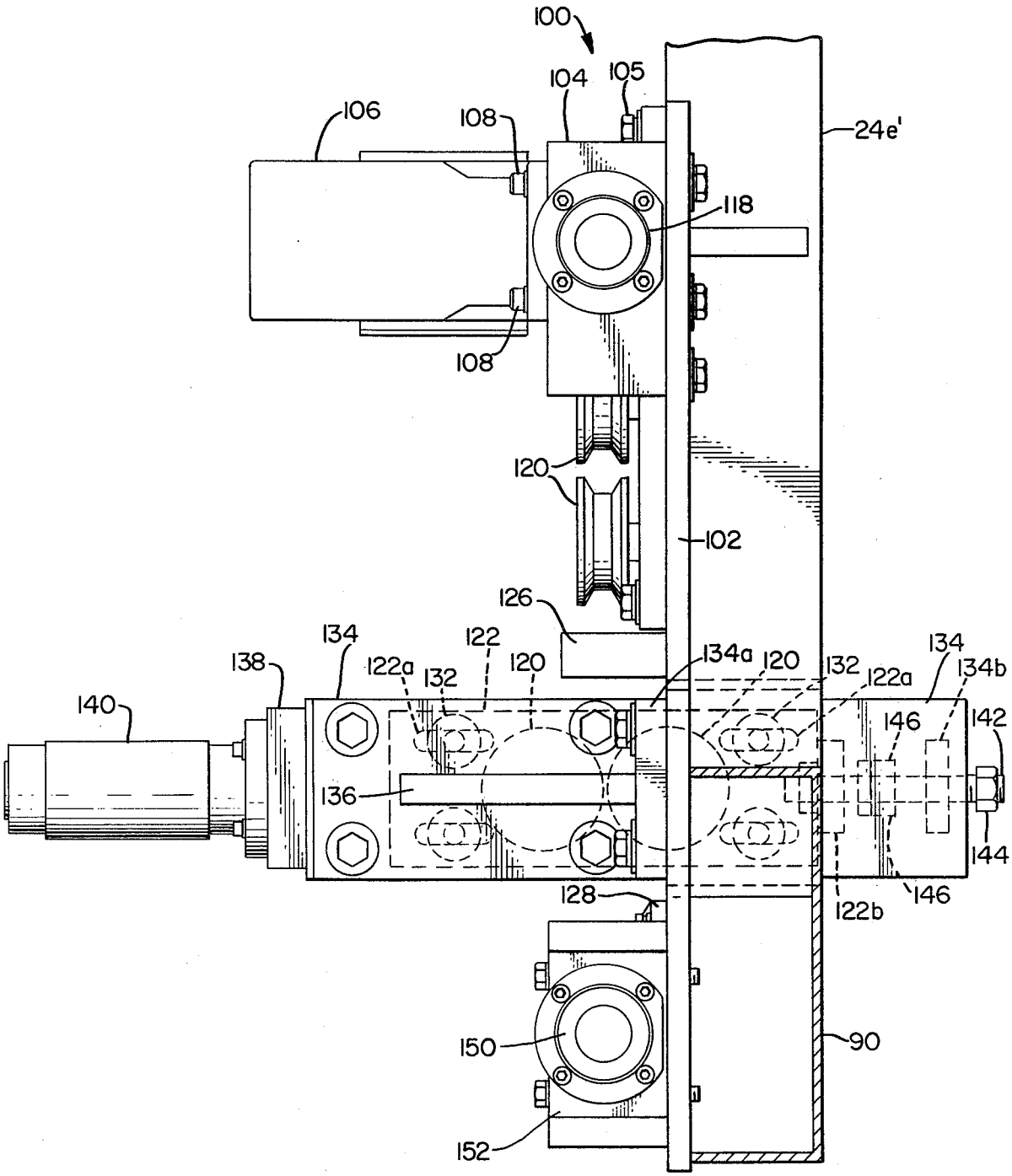
FIG. 10 is a view in side elevation taken along the line 10—10 in FIG. 9.

With reference to FIGS. 5 and 9–10, a strand straightener and deflection assembly 100 is mounted on each exit end 24e, 24e' of the booms. A rectangular mounting plate 102 is welded to the exit end with its surface facing the strand flush with the side wall 24a of the exit end. A bracket 104 is mounted on the plate 102 at its upper end by shoulder screws 105 that engage horizontally extending slots 104a in the bracket. A hydraulic motor 106 secured to the bracket 104 by cap screws 108 powers a drive pulley 110. An opposed idler roller 112 is mounted on a shaft 114 secured in an upper portion of a pulley plate 116. A hydraulic cylinder 118 secured to a mounting bracket 104 translates the bracket 104 horizontally to carry the motor 106 and the drive pulley 110 between strand-engaging and strand-disengaging positions. The motor 106 and drive pulley 110 supply motive force to the strand when it is not engaged by the withdrawal machine 22, as when the strand is terminated. This "final" drive system thus ensures that the final portions of any strand is coiled.

The straightener assembly has eight strand-engaging rolls 120 organized in opposed pairs. Four upper pulleys 120 are mounted on the lower portion of the pulley plate 116. The lower four pulleys 120 are mounted in pairs on a slide block 122 and a second slide block 124. The slide blocks 122 and 124 are oriented perpendicular to one another and to the strand. Upper and lower guide blocks 126 and 128, respectively, direct the strand to the nip of the slide bar pulley pairs. The guide spacing of the lower guide block 128 is sufficient to accommodate horizontal movement of the lower slide bar 124. The upper guide block 126 projects from the face of the mounting plate 102 to accommodate a similar movement of the slide block 122.

Figure 11:
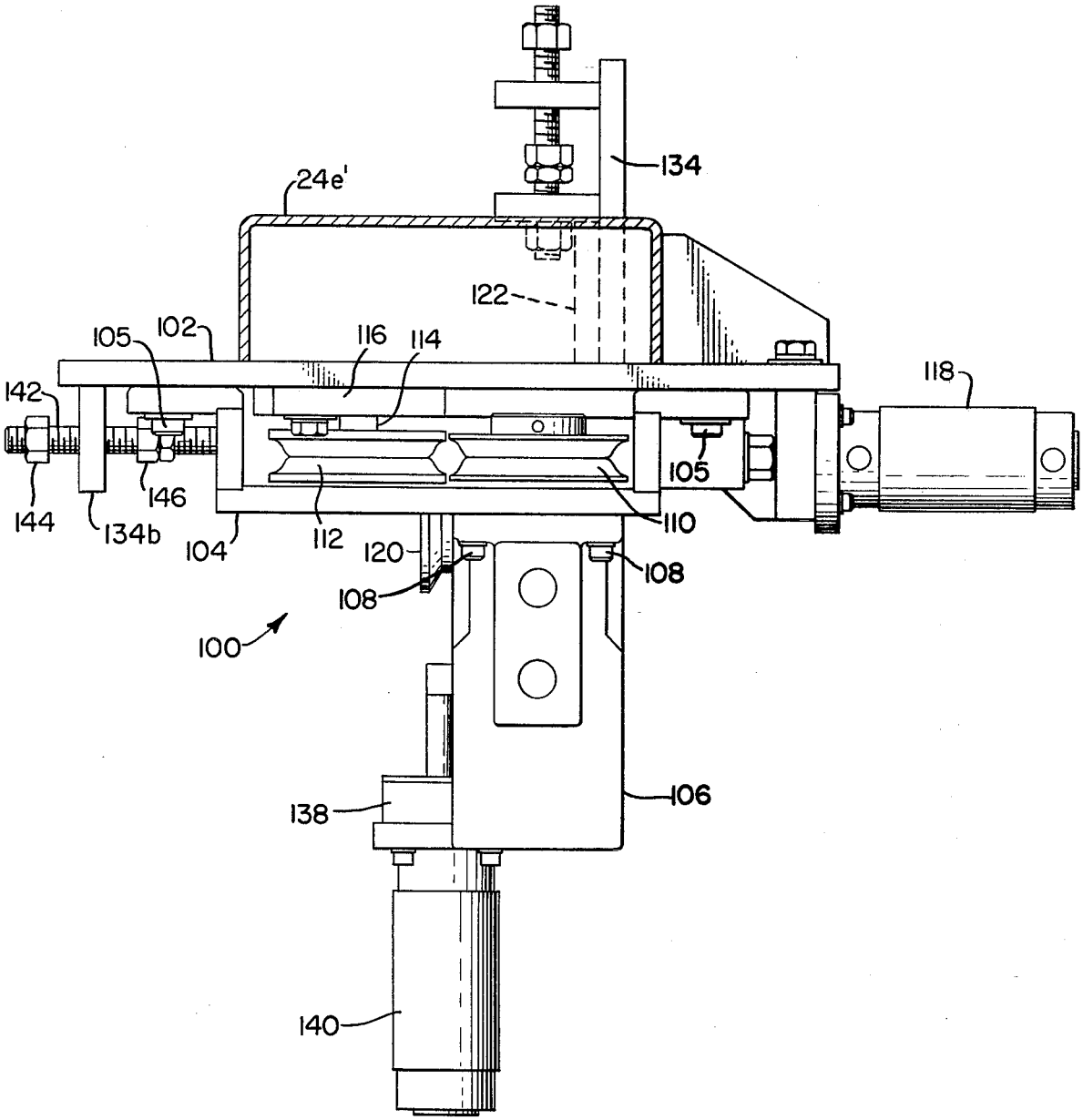
FIG. 11 is a top plan view partially in section taken along the line 11—11 of FIG. 9.

The upper slide block 122 extends through an opening 130 in the mounting plate 102 and the boom exit end. The slide bar is supported on shoulder screws 132 (FIG. 10) that engage elongated slots 122a in the slide block and thread into a T-shaped mounting bracket 134 having one leg 134a secured to the mounting plate 102. A plate 136 reinforces the bracket 134. One end of the bracket 134 supports an L-shaped mounting bracket 138 that carries a hydraulic cylinder 140. The cylinder 140 drives the slide bar between two limit positions that each deflect the strand laterally a small, equal distance from a vertical path. An adjustment rod 142 (FIGS. 10 and 11) is threaded into a block 122b secured at the end of the slide opposite the cylinder and passes freely through a parallel block 134b secured to the bracket 134. A nut 144 and a pair of nuts 146 threaded on the rod 142 determine the limit positions of the slide block 122.

The lower slide block 124 is supported on shoulder screws 148 that engage the slide bar in elongated slots 124a and thread into the mounting plate 102. A hydraulic cylinder 150 secured to a mounting bracket 152 drives the slide bar 124 between two limit positions that deflect the strand laterally a small, equal distance from the vertical. These deflections are at right angles to and the same magnitude as the corresponding deflections introduced by movement of the slide bar 122 to its limit positions. An adjusting rod 142' threaded in an end plate of the slide bar 124 and passing freely through a stop block 154 carries nuts 144' and 146' that together determine the limit positions in the same manner as the rod 142 and the nuts 144 and 146. As shown, the slide bars 122 and 124 are in a central position midway between their limit positions. In use the slide bars will be at the limit positions.

In operation of the illustrated preferred embodiment, four strands are up-cast through four mold assemblies 18 by the withdrawal machine 22. The strands are typically copper alloy rods having a diameter ranging from ½ to 1½ inches. The strands are withdrawn in a pattern of forward, reverse and dwell strokes with a net continuous advance that typically ranging up to 200 inches per minute. Because of this extraordinarily high production speed and the nature of the cooling molds 18, the strands are hot when they leave the mold, typically 1500° F.

The diverters 156 each direct an associated strand from the withdrawal machine along a path defined by one set of fairing assemblies 94 and rolls 92 arrayed along one side wall of a boom. The path has gradual bends that guide the strands to a horizontal and a final vertical orientation without fracture due to either the bending or bowing of the strand. In particular, the location of the rolls 92 at the entrance end **24*d* 24*d'* of each boom and an increased spacing L between opposed rolls allows an additional bowing of the strand that is taken up by the reverse stroke. Each strand is cooled as it is guided along this path by air blown into the booms and distributed to the path by the opening 95**. At the end of the boom, the strand has usually cooled to approximately 300°–500° F.

One of the coilers 26 is positioned under each boom exit end **24*e*, 24*e'* with an axis of rotation of the cone 42 aligned with the strand in its undeflected vertical orientation. The cross slides 122, 124** are actuated by conventional sequence timers (not shown) to deflect the strands as it leaves the boom. The deflection occurs in a cyclic, clockwise closed-loop path about the axis of rotation of the cone that passes through four equally spaced feed positions. Each feed position can be viewed as a corner of a horizontal square centered on the cone axis. The deflection movement along the path is intermittent with the strand deflection halting for an equal period at each feed position.

Figure 15:
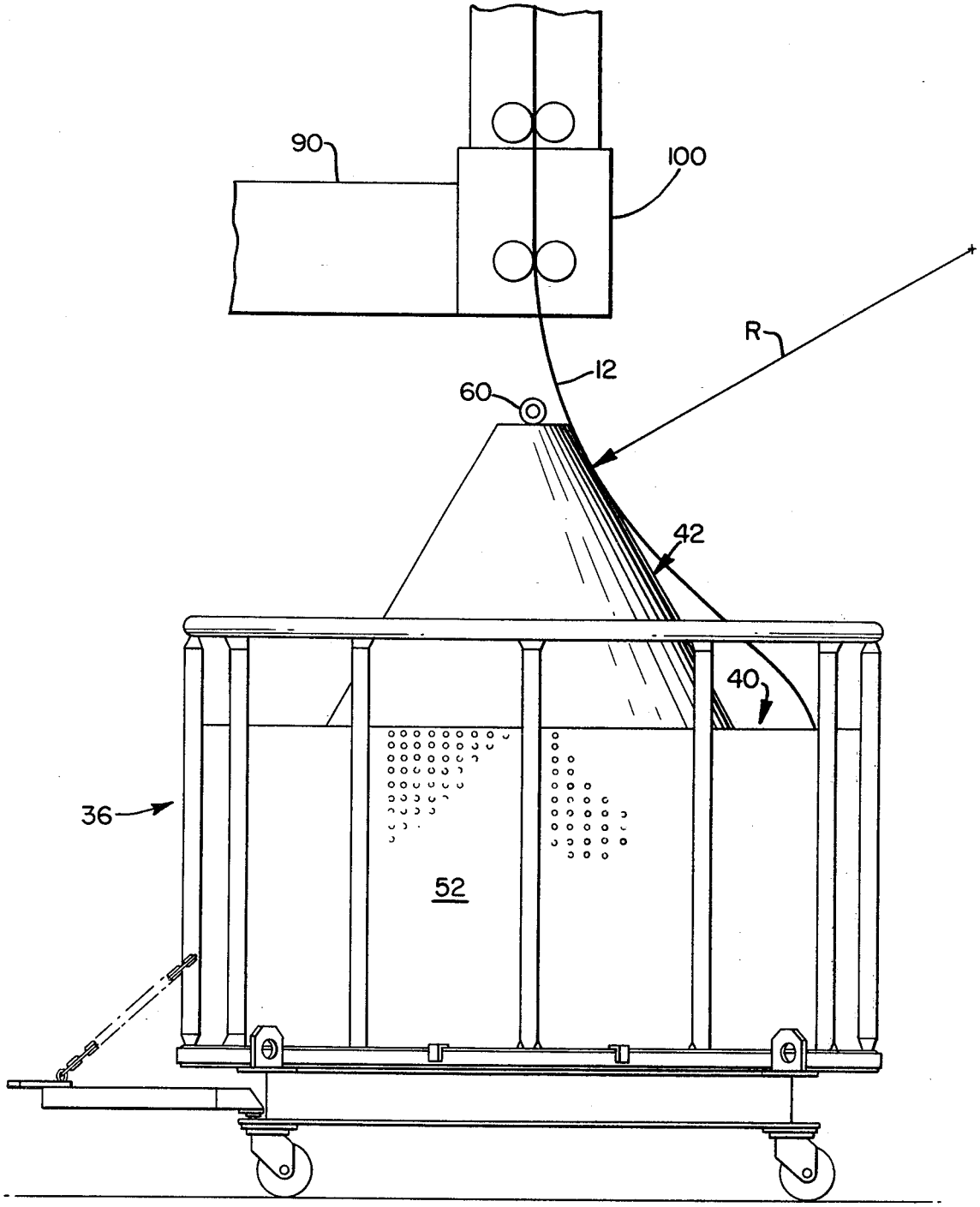
FIG. 15 is a simplified view in side elevation corresponding to FIG. 2 showing the bend radius in the strand introduced by the cone.

A principal feature of this invention is that the angle of the cone 42 and the spacing between each cone and the lower end of the associated straightener deflection assembly 100 is selected to produce a bend radius R (FIGS. 2 and 15) in the strand that contributes to the formation of a uniform, non-tangled coil. It will be understood that the strand assumes a complex shape after it leaves the straightener/deflector 100, having a curvature from a vertical to a horizontal orientation as well as a generally S-shaped curvature projected on a vertical plane, e.g. the plane of the sheet in FIG. 15. The bend radius R is thus a projected radius of the strand that forms the "upper" curve of the S-shape. It has been found that if the bend radius is too large or too small, the coil will climb the inner wall **40*a* or the outer wall 40*c*, respectively. To prevent this problem, it has also been found that the bend radius R should be greater than the radius of the inner wall 40*a* but less than the radius of the outer wall 40*c*. Another guide for the proper bend radius is that the leading end of the strand as it leaves the cone 42 should strike the outer wall 40*c* at approximately one-half to three-quarters of the height of the annular collecting space of the basket 36. As noted above, the minimum diameter of the inner wall is one which will cause the coil to collapse on itself due to its own weight. The outer wall diameter, on the other hand, is restricted primarily by the sag or "wilt" of the unsupported strand as it projects from the cone and the available aisle space in the production area. Preferably the outer wall diameter is less than twice the inner wall diameter. As the strand advances down the sloped surface of the cone 42** the rotation of the cone and the friction between the strand and the cone urge the strand to form a wrap in the selected laying direction. As the coil forms, if the strand tends to reverse itself, the reversal causes it to bear on the rotating cone with an increased frictional force that opposes and overcomes the reversal. This action is most important as the basket approaches a fully-loaded condition.

By way of illustration, but not of limitation, the cone rotates at one revolution per minute and the deflection device completes one cycle of rotation every fifteen minutes. Approximately a dozen turns or loops of the strand are formed at each deflection feed position or "corner". In each position, the tangential component of the frictional force between the strand and the cone draws the wrap against the inner spindle wall **40*a* at a point opposite the direction of the deflection and against the inner surface (the cylinder 52) of the outer wall of the coiler at a point in alignment with the direction of the deflection. As the direction of the deflection rotates, a non-tangled coil is formed in the volume 54**. The non-tangled condition of the coil is very important since the strand can be uncoiled for further fabrication or other handling without jams, or other interruption due to tangles. As noted above, friction between the strand and the rotating cone is also important in preventing a reversal in the laying direction of the strand in the coil collecting volume. For a three-quarter inch brass strand, with a collecting basket having an inside diameter of five feet and an outside diameter of eight feet, the bend radius R is preferably four feet.

When the coiler is filled, the drive rolls of the withdrawal machine are disengaged, the strand is sheared at the coiler, and the coiler is removed for storage or fabrication such as cold rolling. This invention is particularly adapted to forming coils with a weight in excess of 10,000 pounds. An empty coiler 26 is placed under the boom exit end and the drive roll engaged to continue production and coiling. If the strand terminates above the straightener, whether voluntarily or involuntarily, the drive roll pulley 110 of the straightener assembly provides the motive force to continue the advance of the strand along the delivery path to the coiler.

There has been described a coiling system for multiple, hot, continuously advancing metallic strands that forms each strand into uniform, non-tangled coil without synchronization between the speed of the advance and the speed of rotation of the coiler. This coiling system accepts a wide range of production speeds and strand sizes without heavy power trains, fracture of the strand or a reversal of the laying direction. The coiling system also cools the strand before it is coiled to improve the strength and ductility of the strand and reduce surface oxidation.

While the invention has been described with particular reference to the handling and coiling of hot strands produced by up-casting, it will be understood that the system can be readily modified to accommodate other casting directions and cold strands. Also, while the invention has been described with reference to two booms each carrying two strands, other numbers of booms and strands per boom are contemplated. These and other modifications and variations will occur to those skilled in the art from the foregoing detailed description and the accompanying drawings. Such modifications and variations are intended to fall within the scope of the appended claims.

We claim:

1. A coiling system for at least one metallic strand that is continuously advancing along its longitudinal axis from an upcasting apparatus comprising, a hollow boom having a vertically oriented entrance end adapted to receive said strand from said upcasting apparatus, at least one vertically oriented exit end, and an intermediate section extending between said entrance and exit ends and having gradually curved portions adjacent said entrance and exit ends, said boom having at least one vertically oriented side wall and a plurality of holes formed in said wall opposite said strand, a plurality of opposed pairs of strand engaging rolls mounted on said first walls and a plurality of associated pairs of inclined guide plates that direct said strand to the nip of the associated roll pair, means for directing a stream of cooling fluid into said boom, strand straightener means mounted at each of said exit ends, means for cyclically deflecting said strand about the vertical as it leaves each said straightener means, at least one coil receptacle, including a base and concentric inner and outer walls secured on said base, disposed under each of said strand straightener and deflection means, a conical member mounted over each of said inner walls, said strand straightener and deflection means being spaced from said conical member and directing said strand downwardly onto and in frictional sliding engagement with the outer surface of said conical member, and means for rotating said conical member said spacing and the angle of inclination of said outer surface being structured to bend said strand with a bend radius projected on a vertical plane that results in the formation of said coil in a uniform, non-tangled manner.

2. A coiling system according to claim 1 wherein said bend radius is greater than the radius of inner wall and less than the radius of said outer wall.

3. A coiling system according to claim 1 wherein said bend radius is selected so that the leading end of said strand strikes said outer wall at a point between one-half and three-fourths of its height.

4. A coiling system according to claim 2 or 3 wherein the diameter of said inner wall is sufficiently large that each turn of said coil lies in said receptacle in a generally horizontal plane.

5. A coiling system according to claim 1 wherein said strand is brass and has a diameter of approximately three-quarter inch and wherein said conical member outer surface is inclined thirty degrees from the vertical and said spacing is approximately one foot.

6. An apparatus for forming a coil of a metallic strand that is continuously advancing along its longitudinal axis, comprising a coil receptacle including a base and concentric inner and outer walls secured on said base, a conical member mounted over said inner wall, means for directing said strand downwardly onto and in frictional sliding engagement with the outer surface of said conical member, said directing means being vertically spaced from said conical member, and means for rotating said conical member, said spacing and the angle of inclination of said outer surface being structured to bend said strand with a bend radius projected on a vertical plane that results in the formation of said coil in a uniform, non-tangled manner, said bend radius being greater than the radius of inner wall and less than the radius of said outer wall.

7. The coil forming apparatus according to claim 6 wherein the diameter of said inner wall is sufficiently large that each turn of said coil lies in said receptacle in a generally horizontal plane.

8. The coil forming apparatus according to claim 6 wherein the diameter of said outer wall is less than twice the diameter of said inner wall.

9. The coil forming apparatus according to claim 6 wherein the outer surface of said conical member is a coating of a material that is softer than said strand material and compatible with said strand material.

10. The coil forming apparatus according to claim 9 wherein said strand material is brass and said coating is zinc.

11. The coil forming apparatus according to claim 6 wherein said conical member outer surface is inclined thirty degrees from the vertical and said spacing is approximately one foot.

12. An apparatus for forming a coil of a metallic strand that is continuously advancing along its longitudinal axis, comprising a coil receptacle including a base and concentric inner and outer walls secured on said base, a conical member mounted over said inner wall, means for directing said strand downwardly onto and in frictional sliding engagement with the outer surface of said conical member, said directing means being vertically spaced from said conical member, and means for rotating said conical member, said spacing and the angle of inclination of said outer surface being structured to bend said strand with a bend radius projected on a vertical plane that results in the formation of said coil in a uniform, non-tangled manner, said bend radius being selected so that the leading end of said strand strikes said outer wall at a point between one-half and three-fourths of its height.

13. The coil forming apparatus according to claim 12 wherein the diameter of said inner wall is sufficiently large that each turn of said coil lies in said receptacle in a generally horizontal plane.

14. The coil forming apparatus according to claim 12 wherein the diameter of said outer wall is less than twice the diameter of said inner wall.

15. The coil forming apparatus according to claim 12 wherein the outer surface of said conical member is a coating of a material that is softer than said strand material and compatible with said strand material.

16. The coil forming apparatus according to claim 15 wherein said strand material is brass and said coating is zinc.

17. The coil forming apparatus according to claim 12 wherein said conical member outer surface is inclined thirty degrees from the vertical and said spacing is approximately one foot.

18. An apparatus for forming a coil of a metallic strand that is continuously advancing along its longitudinal axis, comprising a coil receptacle including a base and concentric inner and outer walls secured on said base, a conical member mounted over said inner wall, means for directing said strand downwardly onto and in frictional sliding engagement with the outer surface of said conical member, said directing means being vertically spaced from said conical member, and means for rotating said conical member, said spacing and the angle of inclination of said outer surface being structured to bend said strand with a bend radius projected on a vertical plane that results in the formation of said coil in a uniform, non-tangled manner, said strand directing means including means for cyclically deflecting the strand around the axis of rotation of said cone, and, said strand directing means further comprising means for straightening said strand before said deflection.

19. The coil forming apparatus according to claim 18 wherein the diameter of said inner wall is sufficiently large that each turn of said coil lies in said receptacle in a generally horizontal plane.

20. The coil forming apparatus according to claim 18 wherein said strand directing means includes a strand delivery boom having a downwardly extending exit end that mounts said straightener and said cyclic deflection means.

21. The coil forming apparatus according to claim 20 wherein said deflection means comprises a pair of slide bars mounted at right angles to one another and said strand, opposed strand-engaging pulleys rotatably mounted on each of said slide bars, and means for moving each of said slide bars along its longitudinal axis.

22. The coil forming apparatus according to claim 18 wherein the diameter of said outer wall is less than twice the diameter of said inner wall.

23. The coil forming apparatus according to claim 18 wherein the outer surface of said conical member is a coating of a material that is softer than said strand material and compatible with said strand material.

24. The coil forming apparatus according to claim 23 wherein said strand material is brass and said coating is zinc.

25. The coil forming apparatus according to claim 18 wherein said conical member outer surface is inclined thirty degrees from the vertical and said spacing is approximately one foot.

26. An apparatus for forming a coil of a metallic strand that is continuously advancing along its longitudinal axis, comprising a coil receptacle including a base and concentic inner and outer walls secured on said base, a conical member mounted over said inner wall, means for directing said strand downwardly onto and in frictional sliding engagement with the outer surface of said conical member, said directing means being vertically spaced from said conical member, and means for rotating said conical member, said spacing and the angle of inclination of said outer surface being structured to bend said strand with a bend radius projected on a vertical plane that results in the formation of said coil in a uniform, non-tangled manner, said rotating means rotating at a speed greater than the rate of advance of said strand divided by the circumference of said inner wall, said rotating means comprising an electric motor mounted within said inner wall and a drive train operative connected between said motor and said conical member.

27. The coil forming apparatus according to claim 26 wherein the diameter of said outer wall is less than twice the diameter of said inner wall.

28. The coil forming apparatus according to claim 26 wherein the outer surface of said conical member is a coating of a material that is softer than said strand material and compatible with said strand material.

29. The coil forming apparatus according to claim 28 wherein said strand material is brass and said coating is zinc.

30. The coil forming apparatus according to claim 26 wherein said conical member outer surface is inclined thirty degrees from the vertical and said spacing is approximately one foot.

31. A means for guiding a metallic strand continuously advancing along its longitudinal axis from casting apparatus to a coiler comprising, a hollow boom having an entrance and substantially aligned with said strand as it leaves said casting apparatus, an exit end extending vertically downward over said coiler, and an intermediate section extending between said entrance and exit ends and characterized by relatively gradual changes in direction, means for carrying said strand along a first exterior wall of said boom, and a diverter mounted at said boom entrance end for pivotal movement between a first position clear of said strand and a second position where it engages said strand and directs it to said carrying means.

32. The guide means according to claim 31 further comprising means for directing a stream of a cooling fluid from the hollow interior of said boom onto said strand.

33. The guide means according to claim 32 wherein said fluid directing means comprises a series of holes formed in said first walls opposite said strand.

34. The guide means according to claim 31 wherein said carrying means comprises a plurality of opposed rolls rotatably mounted on said boom that engage said strand at their nip.

35. The guide means according to claim 34 wherein said carrying means further comprises a plurality of mutually inclined pairs of guide plates that funnel said strand to the nip of an associated pair of said opposed rolls.

36. The guide means according to claim 34 further comprising strand straightening means mounted at said boom exit end.

37. The guide means according to claim 36 further comprising means for cyclically deflecting said strand about said vertical direction as it leaves said straightening means.

38. The guide means according to claim 31 wherein at least one of said roll pairs disposed at said boom entrance end are spaced apart from one another to allow a slight additional bowing of said strand.

* * * * *